United States Patent [19]

Wada et al.

[11] 4,422,707

[45] Dec. 27, 1983

[54] CRT ANODE CAP

[75] Inventors: Kazuo Wada; Toshita Chihara, both of Yokohama; Tetsuya Saito; Mitsuo Suzuki, both of Tokyo, all of Japan

[73] Assignees: Taisho Denki Kogyo Kabushiki Kaisha; Sony Corporation, both of Tokyo, Japan

[21] Appl. No.: 296,869

[22] Filed: Aug. 27, 1981

[30] Foreign Application Priority Data

Aug. 29, 1980 [JP] Japan ..... 55-122477

[51] Int. Cl.[3] ..... H01R 4/48

[52] U.S. Cl. ..... 339/143 R; 339/61 R; 339/252 R

[58] Field of Search ..... 339/59 R, 61 R, 60 R, 339/143 R, 252 R, 252 P

[56] References Cited

U.S. PATENT DOCUMENTS 2,132,203 10/1938 Clark ..... 339/143 R 4,155,614 5/1979 Hall ..... 339/143 R

*Primary Examiner*—John McQuade

*Assistant Examiner*—Paula Austin

*Attorney, Agent, or Firm*—Gerald J. Ferguson, Jr.; Joseph J. Baker

[57] ABSTRACT

An anode structure attached to free end of an insulated high-tension lead for engagement with a CRT anode button. The anode structure has a radioactive rays shielding portion for shielding radioactive rays emanating from the anode button, an engaging portion for insertion into the anode button and a lead holding portion for holding the insulated high-tension lead.

3 Claims, 4 Drawing Figures

CRT ANODE CAP

BACKGROUND OF THE INVENTION

1. Field of the Invention

The present invention relates to improvement in a CRT (cathode ray tube) anode cap which is provided with an insulated high-tension lead, an anode electrically connected with the free end of the high-tension lead for engagement with a CRT anode button and an insulating cap provided at the free end of the high voltage supply line for housing the anode.

2. Description of the Prior Art

There have heretofore been proposed a variety of CRT anode caps of this kind but the conventional CRT anode caps are all defective in that they do not permit easy attachment of the anode to the CRT anode button and detachment therefrom, and in that they have no function of shielding X-rays and like radioactive rays emanating from the side of the CRT anode button, or even if they have, the function is not satisfactory.

SUMMARY OF THE INVENTION

It is therefore an object of the present invention to provide a novel CRT anode cap which is free from the abovesaid drawbacks of the prior art.

Other objects, features and advantages of the present invention will become more fully apparent from the following detailed description taken in conjunction with the accompanying drawings.

DESCRIPTION OF THE PREFERRED EMBODIMENTS

Figure 1:
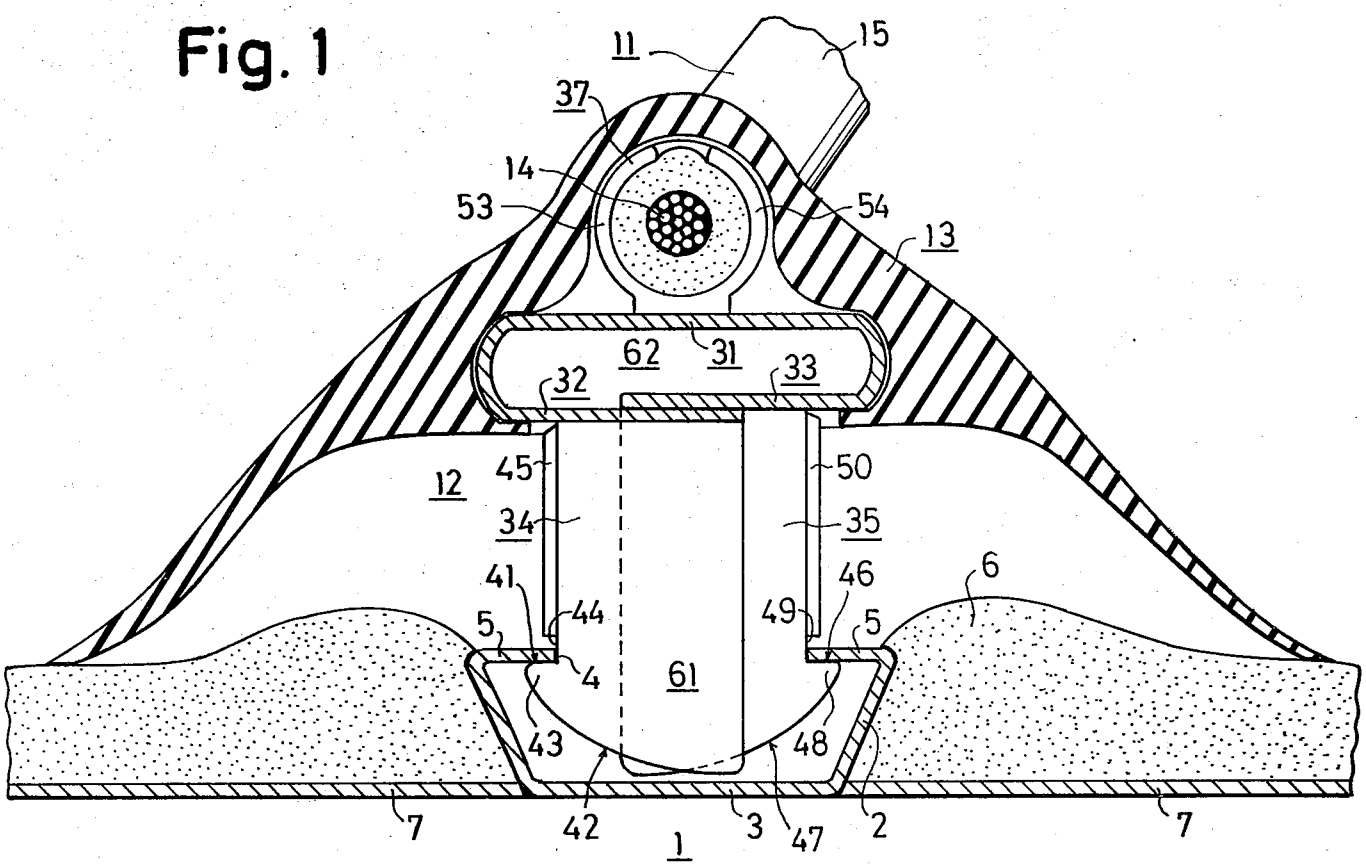
FIG. 1 is a front view schematically showing an embodiment of the CRT anode cap of the present invention, attached to a CRT anode button.

A description will be given of an embodiment of the CRT anode cap of the present invention. The CRT anode button with which the CRT anode cap of the present invention is used has such a structure as indicated generally by 1 in FIG. 1. The CRT anode button 1 comprises a conductive cylindrical member 2, a plate member 3 extending therefrom to close the bottom opening of the cylindrical member 2 and a flange 5 extending from the upper end of the cylindrical member 2 inwardly thereof to define an opening 4 for the cylindrical member 2. The CRT anode button 1 is buried in a CRT envelope wall 6, with the plate member 3 coupled with a conductive layer 7 formed on the interior surface of the envelope wall 6 and the cylindrical member 2 communicating with the outside through the opening 4 defined by the flange 5.

As illustrated in FIG. 1, the CRT anode cap of the present invention has, as usual, an insulated high-tension lead 11, an anode structure 12 electrically coupled with its free end for engagement with the abovesaid anode button 1 and an insulating cap 13 provided at the free end of the high voltage supply lead 11 for housing the anode structure 12. The high voltage supply lead 11 is, as usual, composed of a core conductor 14 and an outer insulating coating 15. In this case, the insulating coating 15 is removed at the free end of the high-tension lead 11 to expose the core conductor 14 and the anode structure 12 is electrically coupled with the exposed portion of the core conductor 14 as described later and, further, the insulating cap 13 is provided at the free end of the high-tension lead 11 for housing the anode structure 12. Since the insulating cap 13 is not directly related to the subject matter of the present invention, no detailed description will be given thereof.

Figure 2:
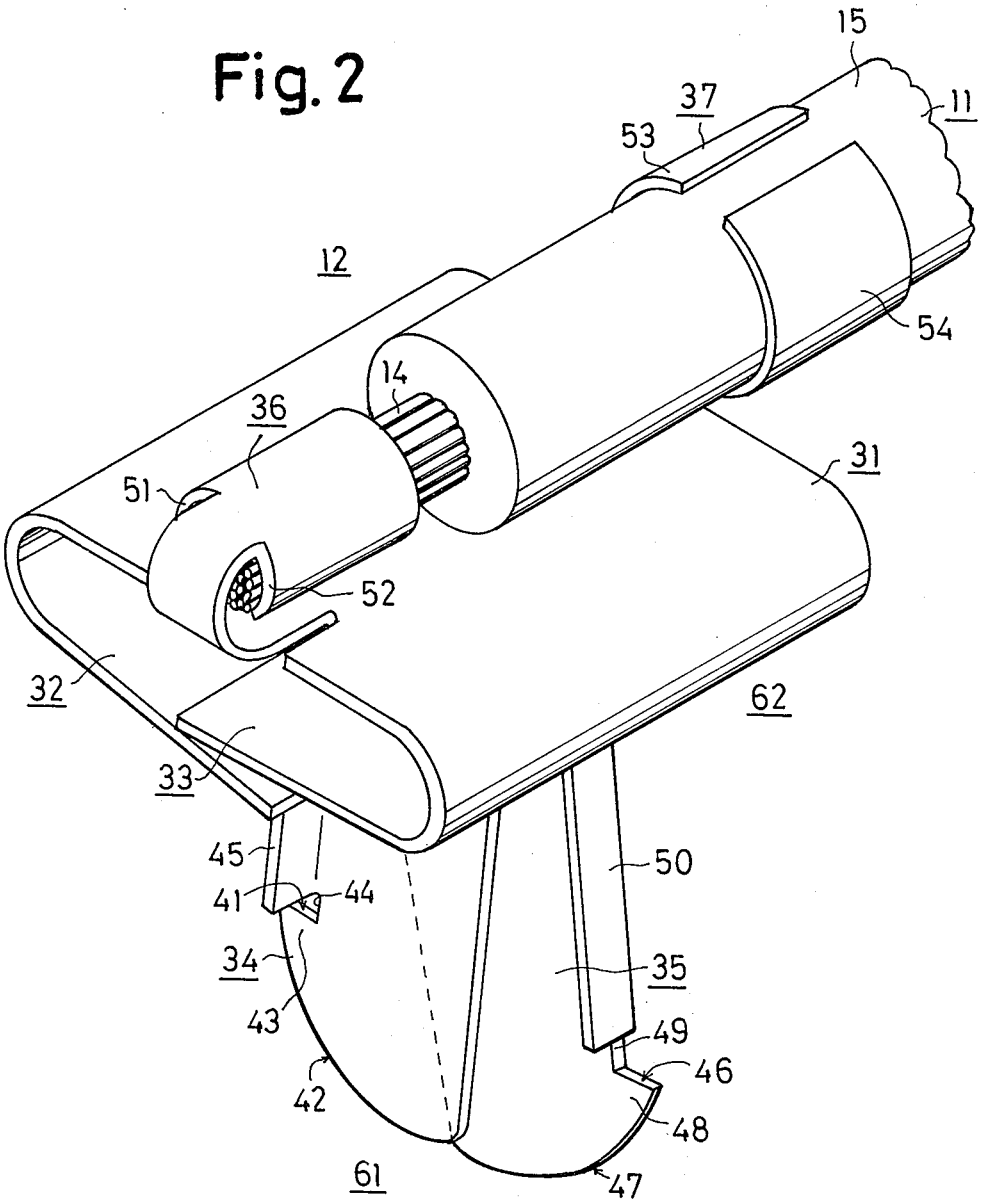
FIGS. 2 and 3 are its perspective views from the upper right and the lower right direction.
Figure 3:
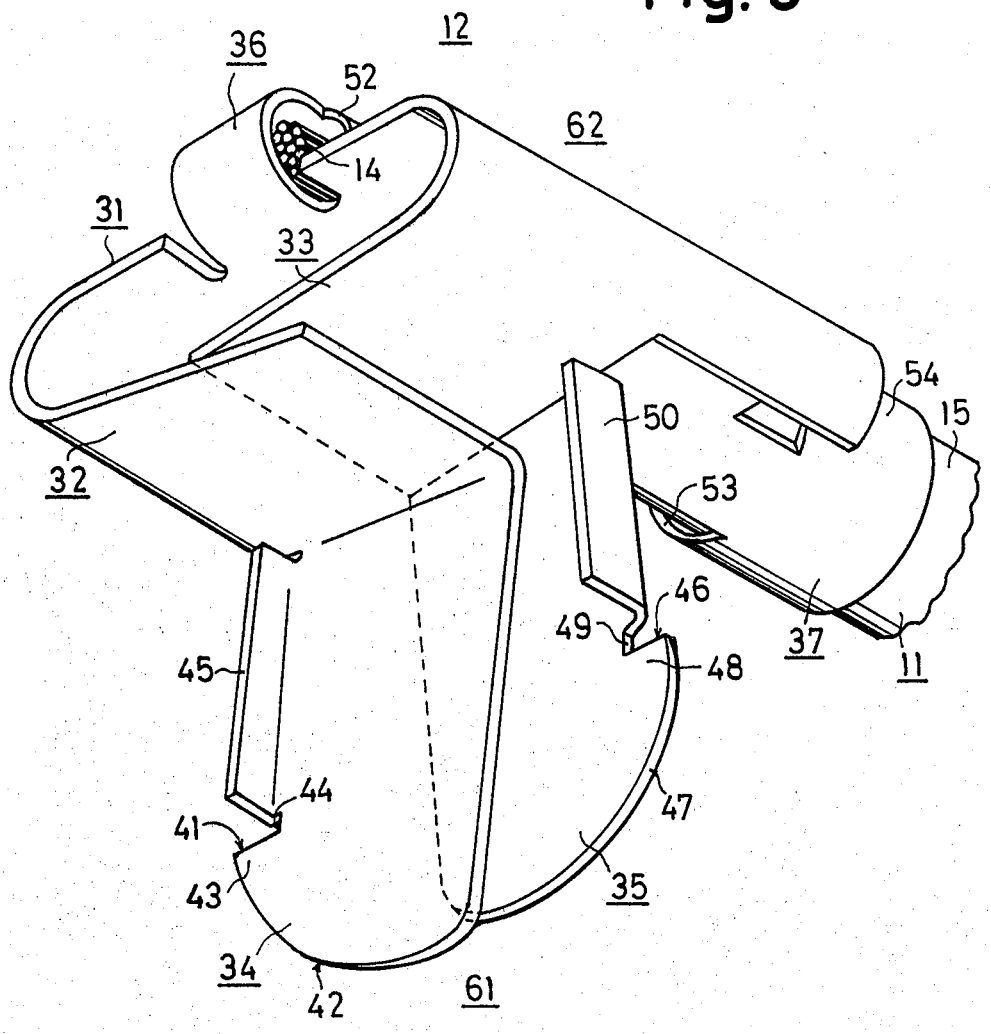

As is evident from FIGS. 2 and 3, the anode structure 12 has a square-shaped conductive plate member 31, square-shaped conductive plate members 32 and 33 which extend from left and right free end portions of the plate member 31 and are folded back to the right and the left, respectively to underline the front half portion of the plate member 31 in opposing relation thereto, square-shaped conductive plate members 34 and 35 which extend downwardly from the rear free end portions of the plate members 32 and 33, respectively, and conductive plate members 36 and 37 which extend outwardly from the front and rear free end portions of the conductive plate member 31, respectively.

In this case, the free end portions of one of the conductive plate members 32 and 33, for example, 33 extends in a manner to make sliding contact with the upper surface of the other conductive plate member 32, and at least the right-hand portion of one of the conductive plate members 34 and 35, for example, 34 makes sliding contact with or lies adjacent to at least the left-hand portion of the other conductive plate member 35 on the front side thereof. The conductive plate member 34 has, in its lower left portion, an anode button engaging piece 43 provided with a stepped portion 41 extending outwardly to the left and a slope 42 extending down therefrom to the right, and a flange receiving facet 44 extending upwardly from the stepped portion 41; furthermore, the conductive plate member 34 has a holding piece 45 formed by bending, for example, to the front, the marginal portion extending upwardly from the flange receiving facet 44. The conductive plate member 35, has, in its lower right portion, an anode button engaging piece 48 provided with a stepped portion 46 extending outwardly to the right and a slope 47 extending down therefrom to the left, and a flange receiving facet 49 extending upwardly from the stepped portion 46; furthermore, the conductive plate member 35 has a holding piece 50 formed by bending to the front the marginal portion extending upwardly from the flange receiving facet 49. The conductive plate member 36 is formed by turning back the front free end portion of the conductive plate member 31 at the center thereof to overlie it in opposing relation thereto and has core conductor holding pieces 51 and 52 respectively bent down from the left-hand and right-hand free end portions of the backwardly extending portion. The conductive plate member 37 has high-tension lead holding pieces 53 and 54 respectively bent up from its left-hand and right-hand free end portions. The anode structure 12 of the abovesaid construction can be obtained by punching and bending a conductive and resilient plate as of stainless steel.

The conductive plate members 34 and 35 of the anode structure 12 constitute an engaging portion 61 for engagement with the CRT anode button 1. The conductive plate members 31, 32 and 33 form a radioactive-rays shielding portion 62 for shielding radioactive rays emanating from the anode button 1. The conductive plate member 36 is electrically coupled with the high-tension lead 11 resiliently holding the exposed portion of its core conductor 14 by the core conductor holding pieces 51 and 52. The conductive plate member 37 resiliently holds the high-tension lead 11 at one end by the high-tension lead holding pieces 53 and 54.

The above is a description of the arrangement of an embodiment of the CRT anode cap according to the present invention. With such an arrangement, the conductive plate member 34 of the anode structure 12 is biased to the left through the conductive plate member 32 by the resiliency of the bend between the conductive plate members 31 and 32 and the conductive plate member 35 is biased to the right through the conductive plate member 33 by the resiliency of the bend between the conductive plate members 31 and 33. By pressing the anode structure 12 against the CRT anode button 1 from the side of the insulating cap 13, the slope 42 of the engaging piece 43 of the conductive plate member 34 and the slope 47 of the engaging piece 48 of the conductive plate member 35 are urged against the flange 5 of the anode button 1 to slide down into the opening 4. Namely, by the downward sliding movement, the lower left portion of the conductive plate member 34 and the lower right portion of the conductive plate member 35 are pressed to the right and the left, respectively, against the aforementioned resiliency and the lower end portions of the both conductive plate members 34 and 35 are inserted into the cylindrical portion 2 of the anode button 1. Upon disengagement of the slopes 42 and 47 from the flange 5 of the anode button 1, the conductive plate members 34 and 35 are snapped back by the abovesaid resiliency to urge their flange receiving facets 44 and 49 against the flange 5. In this way, the anode structure 12 is fitted into the anode button 1. Once the anode structure 12 is thus attached to the anode button 1, they are firmly held together, by the engagement of the stepped portions 41 and 46 of the engaging pieces 43 and 48 of the conductive plate members 34 and 35 with the underside of the flange 5.

The anode structure 12 can easily be detached from the anode button 1 by raising the former from the latter while pressing inwardly the holding pieces 45 and 50 of the conductive plate members 34 and 35 through the insulating cap 13 against the aforementioned resiliency to disengage the flange receiving facets 44 and 49 of the engaging pieces 43 and 48.

The CRT anode cap of the present invention described above allows much ease in attaching the anode structure 12 to the anode button 1 as it is sufficient only to press the former toward the latter as described above and in detaching the anode structure 12 from the anode button 1 as it is sufficient only to bring up the former while holding it as described above. Further, when the anode structure 12 is held on the anode button 1, the conductive plate members 31, 32 and 33 entirely cover the anode button 1 to effectively prevent unnecessary radiation therefrom of radioactive rays to the outside. Moreover, the flange receiving facets 44 and 49 of the conductive plate members 34 and 35 are urged against the flange 5 of the anode button 1 by virtue of the resiliency of the bends between the conductive plate members 31 and 32 and between the conductive plate members 31 and 33, ensuring to achieve electrical connection between the anode structure 12 and the anode button 1.

Figure 4:
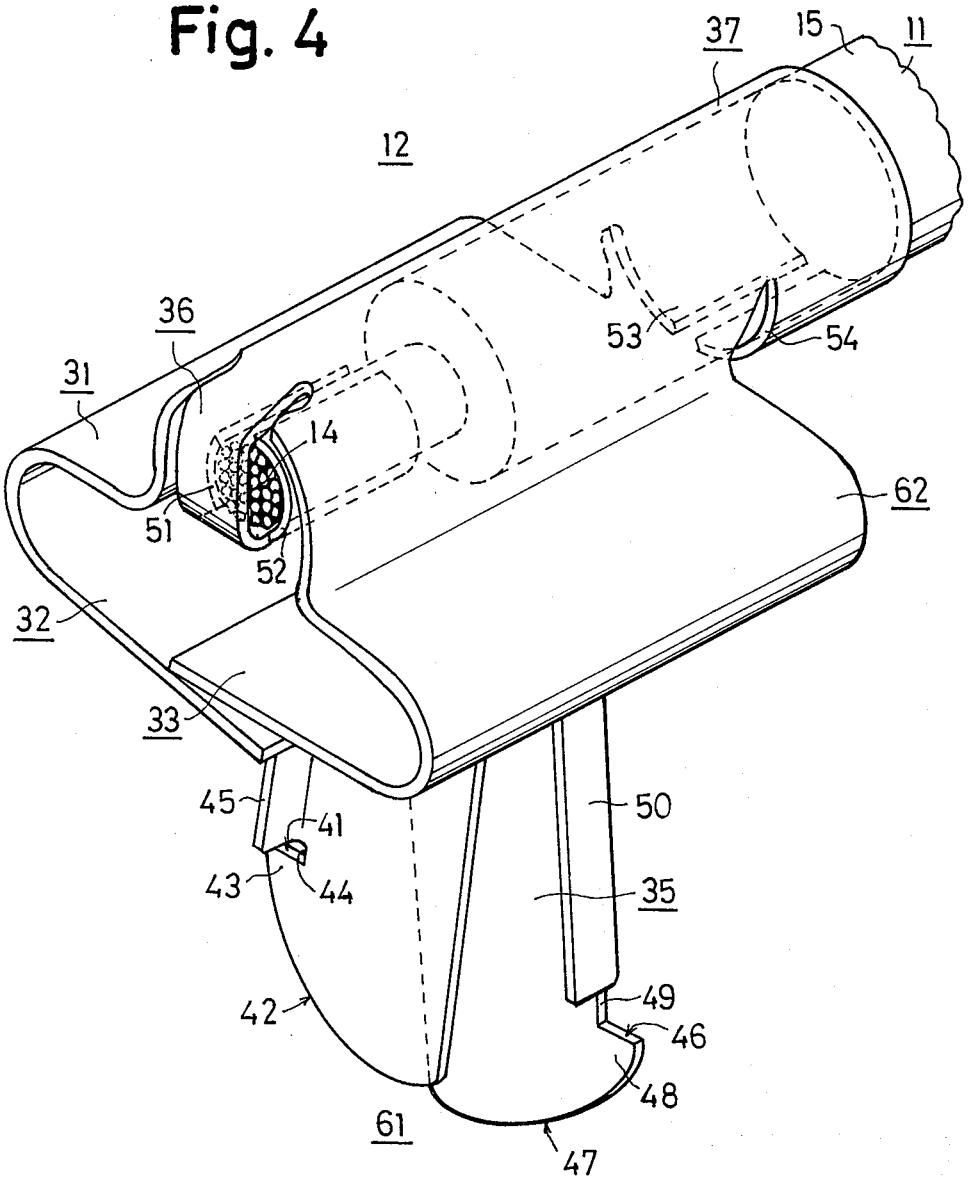
FIG. 4 is a perspective view schematically illustrating another embodiment of the CRT anode cap of the present invention.

While in the foregoing an embodiment of the CRT anode cap of the present invention has been described, it is also possible to employ such an arrangement as depicted in FIG. 4. In FIG. 4, the conductive plate member 36 is formed by turning back the front free end portion of the conductive plate member 31 at the center thereof to extend between the conductive plate member 31 and those 32 and 33. The core conductor holding pieces 51 and 52 of the conductive plate member 36 are formed by bending up its left-hand and right-hand free end portions to hold the core conductor 14 of the high-tension lead 11. Further, the high-tension lead holding pieces 53 and 54 of the conductive plate member 37 are bent down to hold the lead 11. In this case, the conductive plate member 31 may preferably be curved to project upwardly so that the end portion of the high-tension lead 11 may easily be disposed between the conductive plate member 31 and those 32 and 33.

It will be apparent that many modifications and variations may be effected without departing from the scope of the novel concepts of this invention.

What is claimed is:

1. A CRT anode cap which is provided with an insulated high-tension lead, an anode structure electrically connected with the free end of the insulated high-tension lead for engagement with a CRT anode button, and an insulating cap provided at one end portion of the insulated high-tension lead for housing the anode structure, wherein the anode structure has a first conductive plate member, second and third conductive plate members extending from left and right free end portions of the first conductive plate member and folded back to the right and the left, respectively, to underlie the first conductive plate member in opposing relation thereto, fourth and fifth conductive plate members extending downwardly from the rear free end portions of the second and third conductive plate members, respectively, and sixth and seventh conductive plate members extending from the front and rear free end portions of the first conductive plate member, respectively; wherein the fourth conductive plate member has, in its lower left portion, a first anode button engaging piece provided with a first stepped portion extending outwardly to the left and a first slope extending down therefrom to the right, and a first flange receiving facet extending upwardly from the first stepped portion; wherein the fifth conductive plate member has, in its lower right portion, a second anode button engaging piece provided with a second stepped portion extending outwardly to the right and a second slope extending down therefrom to the left, and a second flange receiving facet extending upwardly from the second stepped portion; wherein the fourth and fifth conductive plate members constitute an engaging portion for engagement with the CRT anode button; wherein the first, second and third conductive plate members constitute a radioactive rays shielding portion for shielding radioactive rays emanating from the side of the CRT anode button; wherein the sixth conductive plate members is electrically connected with the insulated high-tension lead; and wherein the seventh conductive plate member holds the insulated high-tension lead.

2. A CRT anode cap according to claim 1 wherein the sixth conductive plate member is formed by folding back the front free end portion of the first conductive plate member at the center thereof to overlie it in opposing relation thereto and has first and second core conductor holding pieces formed by bending down the left and right free end portions of the backwardly extending portion of the sixth conductive plate member, respectively, and wherein the seventh conductive plate member has first and second high-tension lead holding pieces formed by bending up its left and right free end portions, respectively.

3. A CRT anode cap according to claim 1 wherein the sixth conductive plate member is formed by folding back the front free end portion of the first conductive plate member at the center thereof to lie between it and the second and third conductive plate members and has first and second core conductor holding pieces formed by bending up its left and right free end portions, respectively, and wherein the seventh conductive plate member has first and second high-tension lead holding pieces formed by bending down its left and right free end portions, respectively.

* * * * *